US006334602B1

(12) United States Patent
Clarke

(10) Patent No.: US 6,334,602 B1
(45) **Date of Patent: *Jan. 1, 2002**

(54) TRACK SYSTEM FOR ADJUSTABLY MOUNTING OBJECTS TO A STRUCTURE

(76) Inventor: Gregory A. Clarke, 1253 Wayne Court, London, Ontario (CA), N6K 3Z7

( * ) Notice: Subject to any disclaimer, the term of this patent is extended or adjusted under 35 U.S.C. 154(b) by 0 days.

This patent is subject to a terminal disclaimer.

(21) Appl. No.: 09/452,428

(22) Filed: Dec. 1, 1999

Related U.S. Application Data

(63) Continuation-in-part of application No. 09/195,160, filed on Nov. 18, 1998.

(51) Int. Cl.[7] ..... A47G 1/24
(52) U.S. Cl. ..... 248/495; 248/490
(58) Field of Search ..... 248/476, 298.1, 248/490, 495, 497, 489, 493, 257, 265, 269, 259; 211/85.9, 85.3

(56) References Cited

U.S. PATENT DOCUMENTS

| | | | | |
|---|---|---|---|---|
| 956,696 A | | 5/1910 | Frost | |
| 1,758,292 A | | 5/1930 | Meyer et al. | |
| 1,844,096 A | | 2/1932 | Levene | |
| 2,469,923 A | | 5/1949 | Jones | |
| 2,681,194 A | * | 6/1954 | Halvorsen | 248/495 |
| 2,976,005 A | | 3/1961 | Stell | |
| 3,729,627 A | | 4/1973 | Littell | |
| 3,838,842 A | | 10/1974 | McCracken | |
| 3,945,599 A | | 3/1976 | Spier et al. | |
| 4,611,779 A | | 9/1986 | Leonard, Jr. | |
| 4,645,165 A | * | 2/1987 | Raap | 248/476 |
| 4,678,151 A | | 7/1987 | Radek | |
| 4,771,897 A | | 9/1988 | Ho | |
| 4,775,127 A | | 10/1988 | Nakamura | |
| 4,892,284 A | | 1/1990 | Kelrick | |
| 4,973,021 A | * | 11/1990 | Schuite | 248/495 |
| 5,069,411 A | * | 12/1991 | Murphy | 248/476 |
| 5,342,014 A | | 8/1994 | Wilson | |
| 5,381,991 A | * | 1/1995 | Stocker | 248/206.5 |
| 5,816,557 A | * | 10/1998 | Tepper | 248/495 |
| 5,992,813 A | | 11/1999 | Keers | |
| 6,003,825 A | | 12/1999 | Abernathy, Jr. | |
| 6,062,525 A | * | 5/2000 | Lemire | 248/475.1 |

OTHER PUBLICATIONS

Martha Stewart, "Decorating Details", 1998, pp. 16–17 (cover and inside front cover pages also enclosed).

* cited by examiner

*Primary Examiner*—Anita King
(74) *Attorney, Agent, or Firm*—Bereskin & Parr

(57) ABSTRACT

A track system for adjustably mounting objects to a structure, such as a wall having an uneven surface, includes a track, and a plurality of longitudinally spaced connectors. Each connector consists of an adjuster and a fastener. The adjuster preferably includes a threaded sleeve, and a foot having a flat bottom surface for bearing against the surface of the structure. Each threaded sleeve is dimensioned to fit within a corresponding threaded aperture in the back wall of the track. The adjuster preferably includes a pivoting foot which provides full wall surface contact notwithstanding local surface irregularities. The track may include a back wall assembly and a cover. The back wall assembly preferably includes a plurality of sliding wall sections which are tied to a footer and a header by means of a tie-bar. The cover preferably includes a magnetic metal plate which contacts a magnet located on the tie-bar, when the cover is fitted over the back wall assembly. The track system may also include a carriage shaped for engaging and sliding along the track, having a mounting device for mounting an object thereto.

21 Claims, 14 Drawing Sheets

TRACK SYSTEM FOR ADJUSTABLY MOUNTING OBJECTS TO A STRUCTURE

RELATED APPLICATION

This application is a continuation-in-part of Application Ser. No. 09/195,160, entitled "Track System for Wall Hangings", filed on Nov. 18, 1998.

FIELD OF THE INVENTION

This invention relates to track systems for adjustably mounting wall hangings and other objects on structures such as interior walls or ceilings having uneven surfaces.

BACKGROUND OF THE INVENTION

Paintings, prints, pictures, and other wall hangings are typically mounted on residential and commercial wall surfaces by a hook or other securing device which penetrates the wall surface. To reposition the wall hanging at some other location on the wall surface, it is necessary to remove and reposition the securing device. The removal of hooks or nails from the wall causes damage to the wall surface and creates, unsightly holes which must be filled and refinished or hidden from view by another wall hanging. Also, if the wall structure is not strong enough to support heavier wall hangings, it is necessary to attach the securing de-vice to the upright studs within the wall. This restricts the horizontal placement of the wall hanging to the vicinity of a wall stud.

Track systems have been developed to allow a user to position a wall hanging in a variety of locations on a wall surface without the need for individual hooks or nails. For example, U.S. Pat. No. 5,342,014 to Wilson, describes a display system for artwork which uses a moulding bracket attached to the top of a wall and a plurality of vertical display units attached to and slidable along the moulding bracket.

However, this prior art display system does not facilitate convenient horizontal movement of the vertical display units. A user must first loosen the screws that couple the vertical bar with the horizontal bar before the vertical bar can be moved horizontally within the horizontal bar. This display system also fails to compensate for an uneven wall, since the horizontal track is mounted directly onto the wall. This could result in the horizontal track being crooked when mounted. Further, since wall hangings are to be mounted on the vertical display units using a mounting brace secured at the back of the picture, regular wall hangings having wire attachments cannot be accommodated by the display system.

There is accordingly a need for a track system which allows wall hangings to be suspended evenly on an irregular wall surface, and easily repositioned at various positions on a wall without damaging the wall surface. There is also a need for a track system which can be used in association with conventionally wire hung wall hangings.

SUMMARY OF THE INVENTION

The present invention is directed to a track system for adjustably mounting objects on a structure having an uneven surface, comprising an elongated track dimensioned to extend along the surface, and a plurality of longitudinally spaced connectors extending between the track and the surface for rigidly coupling the track to the surface and aligning the track in a straight line offset from the surface, each of the connectors being individually adjustable in length so as to compensate for local irregularities in the surface. The connectors preferably comprise an adjustor of adjustable length couplable to the track, and a fastener for fastening the adjustor to the structure. The adjustor may comprise a threaded sleeve and a pivotal foot extending from one end thereof having a flat bottom surface for bearing against the surface. The track preferably comprises a back wall assembly and a front cover shaped to cover the back wall assembly. The back wall assembly preferably comprises a plurality of movable wall sections and a series of longitudinally spaced apertures sized to fit the adjustors, the wall sections being movable during installation so as to align one of the apertures with a wall stud or other solid supporting structure. The back wall assembly may comprise a tie bar having a magnet mounted thereon, and the cover may comprise a magnetic portion for contacting the magnet when the cover is fitted onto the back wall assembly.

BRIEF DESCRIPTION OF THE DRAWINGS

The invention will now be described, by way of example only, with reference to the following drawings, in which.

DETAILED DESCRIPTION OF THE PREFERRED EMBODIMENT

Figure 1:
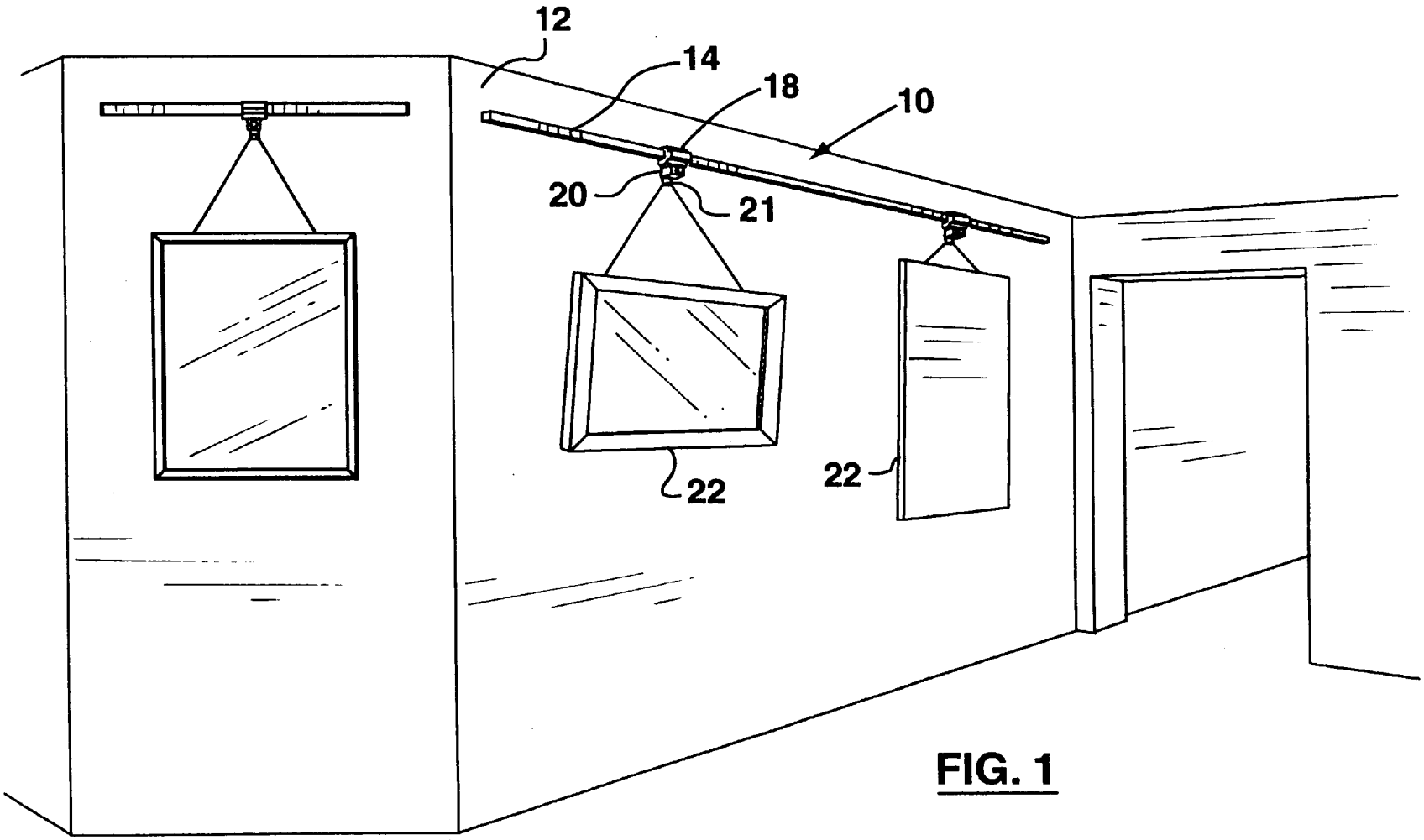
FIG. 1 is a diagrammatic perspective view of the track system mounted on a wall and made in accordance with the present invention.

Referring to FIG. 1, illustrated therein is a track system 10 made in accordance with a preferred embodiment of the present invention. Track system 10 comprises an elongated track 14, track-to-wall connectors (not shown) and carriages 18. Track system 10 is designed to mount a number of wall hangings 22 at various positions on a wall 12.

Track 14 extends horizontally along wall 12, and is rigidly attached to wall 12 by connectors at spaced intervals along the length of track 14. Track 14 is preferably secured about six to fourteen inches below the ceiling on wall 12 to suspend wall hangings 22 at a wide variety of positions on wall 12. Track 14 is preferably constructed from aluminum, although other suitable materials may be used.

Each carriage 18 is shaped to slidably engage track 14 and to slide along the length of track 14. Carriage 18 includes a suspending device 20 having a hook 21 shaped to engage a wire or other attachment element attached to wall hanging 22.

Figure 2:
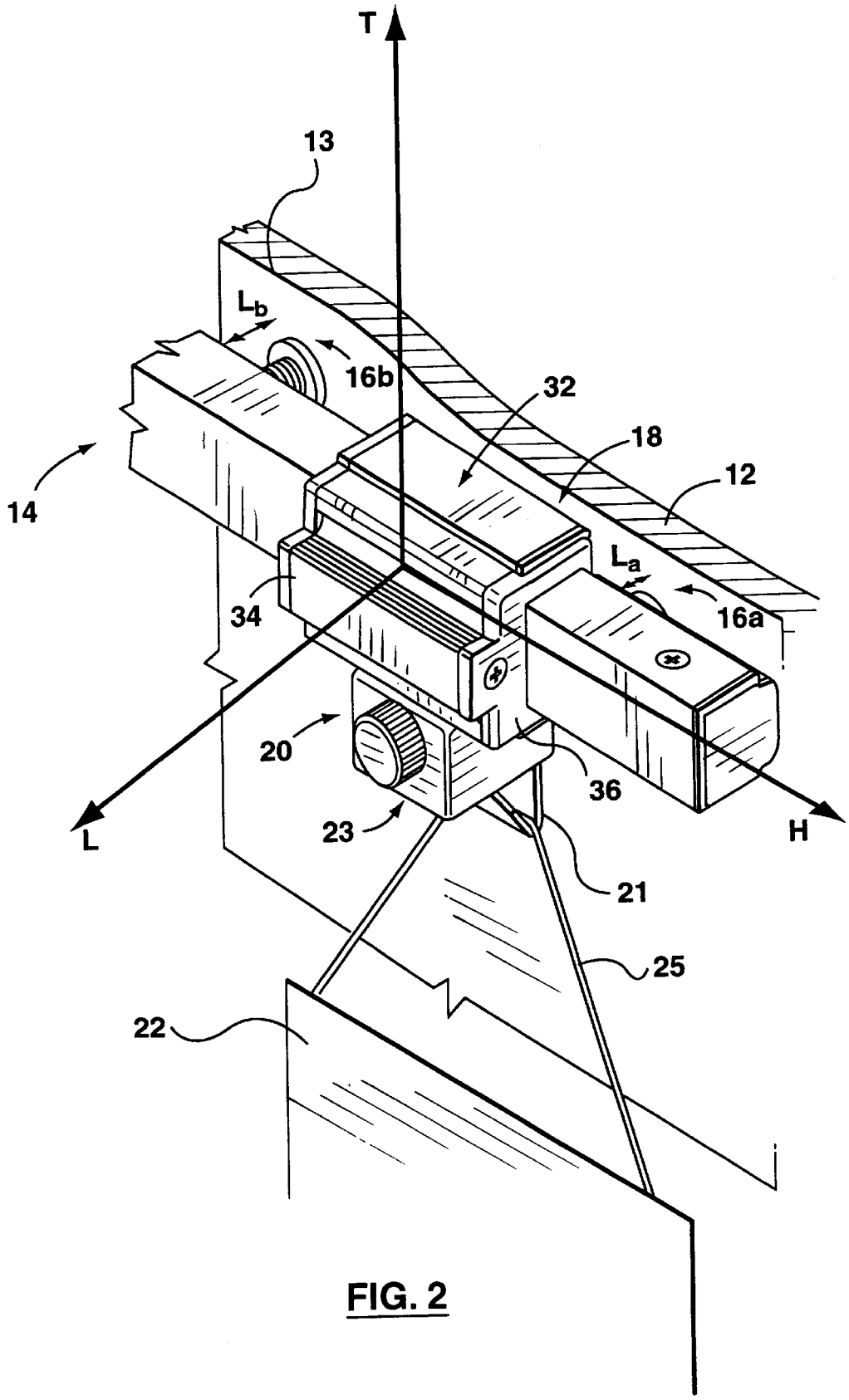
FIG. 2 is a detailed perspective view of a section of the preferred embodiment of the present invention.

FIG. 2 is a perspective view of an end section of track 14 attached to wall 12 by two connectors 16*a* and 16*b*. As shown connectors 16*a* and 16*b* rigidly attach track 14, in a generally horizontal manner, to wall 12. The lateral axis (L) is defined as being perpendicular to the conventionally understood horizontal (H) axis and the transverse (T) axis as indicated by the solid arrows L, H, and T.

Each connector 16*a* and 16*b* attaches a section of track 14 at a lateral distance from wall 12 corresponding to the length of the connector 16*a* and 16*b*, namely $L_a$ and $L_b$, respectively. Wall surface 13 is uneven in the vicinity of connectors 16*a* and 16*b*. In order to compensate for the unevenness of wall surface 13, connector 16*a* is adjusted to have a relatively short length $L_a$ and connector 16*b* is adjusted to have a relatively long length $L_b$. More generally, by adjusting the length of each individual connector 16 along the length of track 14, the entire extent of track 14 can be maintained in a straight horizontal line in spite of an irregular wall surface 13.

Carriage 18 is shaped and dimensioned to be slidably engaged on track 14 so that carriage 18 can slide along the length of track 14, past connectors 16 (such as 16*a* and 16*b*). Carriage 18 preferably comprises carriage body 32 shaped for slidably engaging track 14, a finger grip 34 and end caps 36. Carriage body 32 securably engages track 14 to prevent accidental disengagement while system 10 is in use.

Suspending device 20 is attached to the bottom of carriage 18 and comprises a hook position adjuster 23 coupled to the bottom of carriage body 32 having hook 21 depending therefrom shaped to receive a wire 25 extending upwardly from wall hanging 22.

Figure 3:
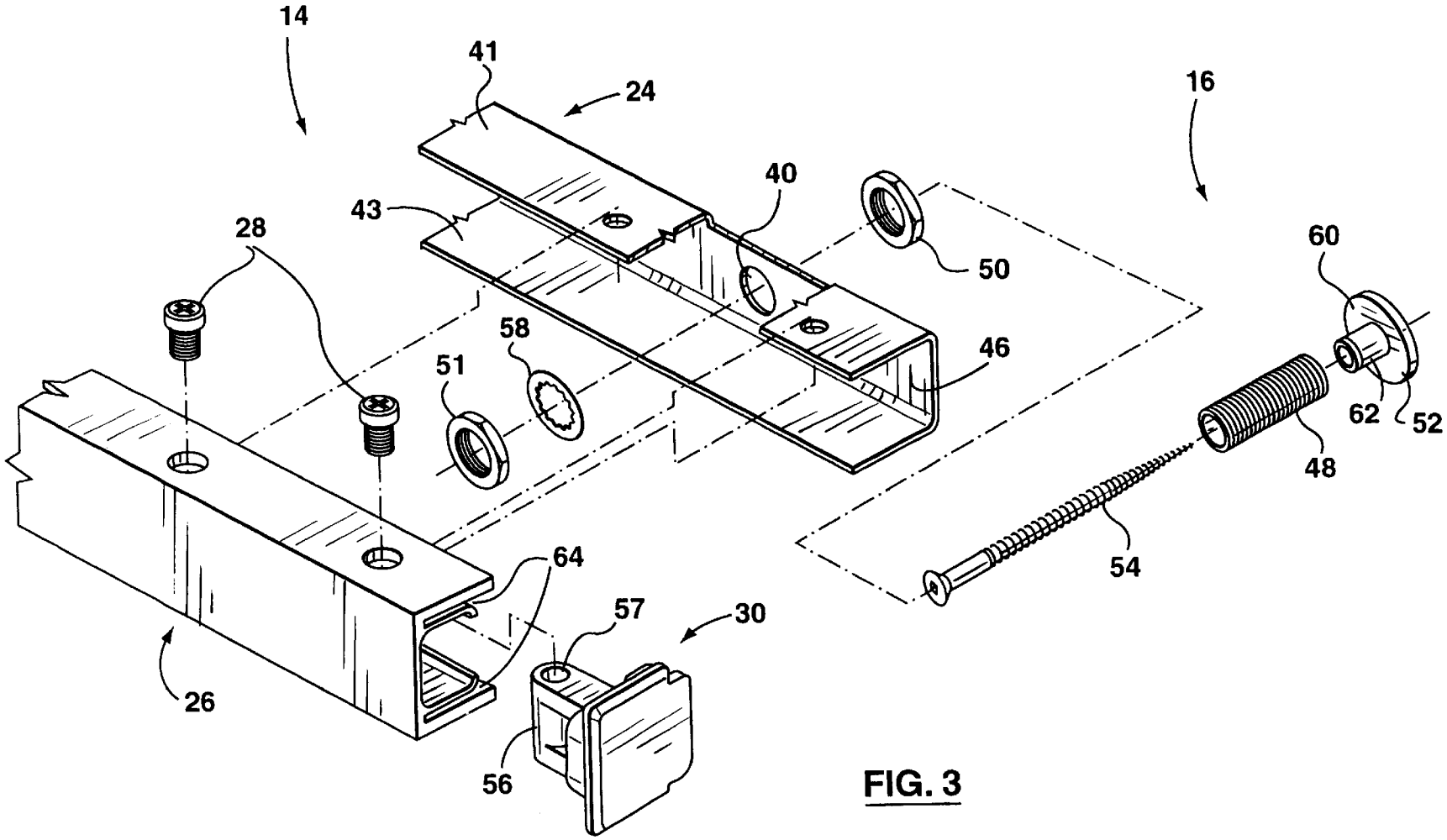
FIG. 3 is an exploded perspective view of the track and a connector of the preferred embodiment of the present invention.

FIG. 3 shows one end of track 14 and connector 16 which is adapted to engage the end section of track 14. Track 14 preferably comprises track beam 24, and track cover 26 having end caps 30.

Track beam 24 comprises top flange 41, bottom flange 43 and back wall or web 46 which contains a plurality of apertures 40 which are sized to receive threaded sleeves 48. Track beam 24 is preferably composed of extruded aluminum, although it could be formed from an elongated aluminum or steel sheet which can be bent into the desired shape. Track cover 26 includes cover slots 64 for receiving flanges 41, 43 of track beam 24. Track end cap 30 is also provided with an extension 56 having an aperture 57 sized to receive screw 28 when track cover 26 is engaged with track beam 24. Track end cap 30 is shaped to snap into the end of track cover 26. Track cover 26 is further secured to track beam 24 by screws 28.

Connector 16 preferably comprises threaded sleeve 48, center point guide 52, a wood screw 54, nuts 50 and 51, and a washer 58. Threaded sleeve 48 is sized to fit within aperture 40 of web 46 of track beam 24, with nut 50 positioned on one side of web 46 and nut 51 and washer 58 positioned on the other side of web 46. Wood screw 54 is dimensioned to fit within threaded sleeve 48 so that the threaded end extends past threaded sleeve 48 and through center point guide 52 for engagement with wall 12.

Center point guide 52 comprises a footing 60 and a sleeve 62. Footing 60 is positioned between threaded sleeve 48 and wall surface 13 and is used to distribute pressure borne by track system 10 along its surface to minimize damage to wall surface 13. Sleeve 62 is used to reduce the diameter of the bore within the threaded sleeve 48 to centre wood screw 54 within threaded sleeve 48 for ease of installation.

Connector 16 is attached to the wall by first inserting center point guide 52 into one end of threaded sleeve 48 and inserting wood screw 54 into the other end, such that the threaded end of wood screw 54 extends past threaded sleeve 48 for engaging wall 12. The resulting assembly is then fastened to wall 12 by wood screw 54 such that center point guide 52 is secured flush against wall surface 13. Nuts 50 are then engaged onto threaded sleeves 48 and aligned to support a straight edge or string line. Track beam 24 is positioned on threaded sleeves 48, and nuts 51 are engaged onto threaded sleeves 48, so that track beam 24 is gripped in between nut pairs 50 and 51 on threaded sleeves 48.

Figure 4:
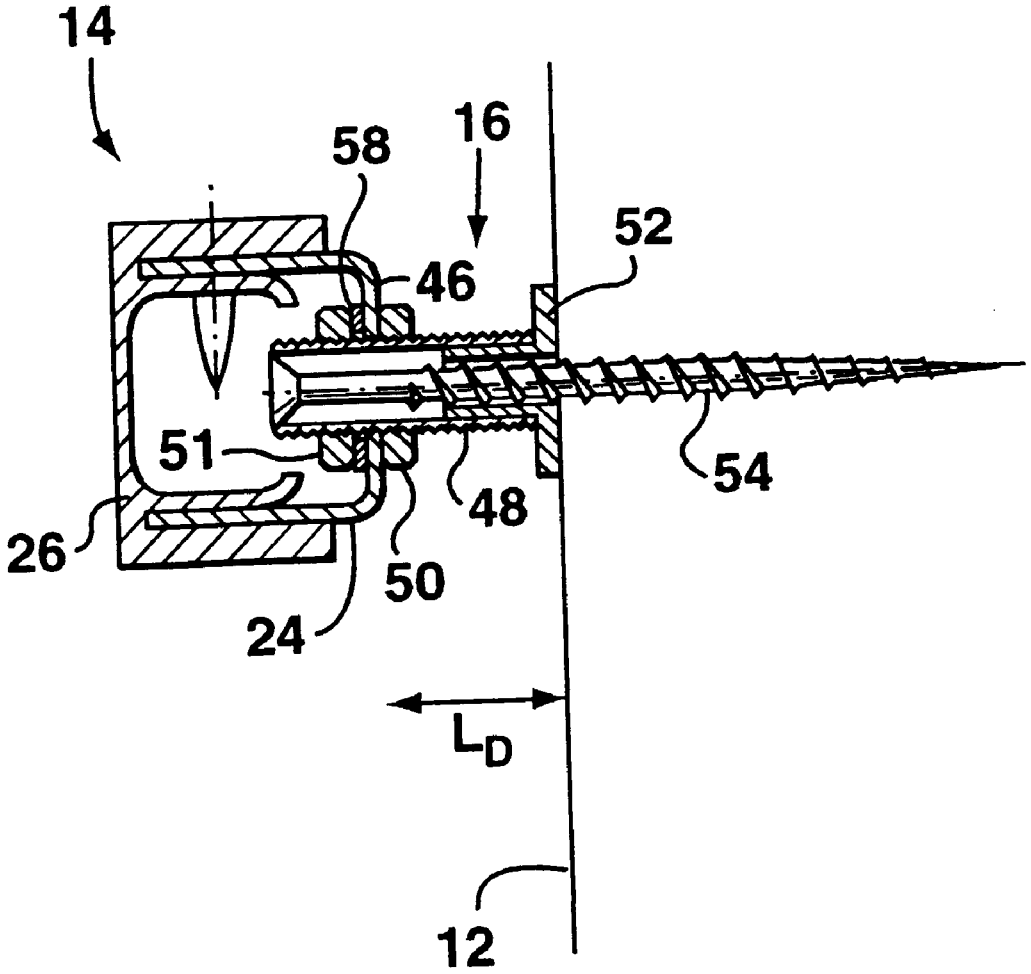
FIG. 4 is a side cross-sectional view of the track engaged to the wall using a connector according to the present invention.

FIG. 4 is a side cross-sectional view of track 14 when it is coupled by connector 16 to wall 12. Wood screw 54 is positioned within threaded sleeve 48 and center point guide 52. The head of wood screw 54 is securely engaged with the free end of threaded sleeve 48 and the threaded end of wood screw 54 is engaged with wall 12 through center point guide 52. In this way threaded sleeve 48 is securely attached to wall 12.

Nuts 50 and 51 and washer 58 are engaged on the outer surface of threaded sleeve 48. Web 46 of track 14 is gripped between nuts 50 and 51 of connector 16. As a result, web 46 is laterally offset from wall surface 13 by distance $L_D$ and track 14 is securely attached by connector 16 to wall 12.

Figure 5:
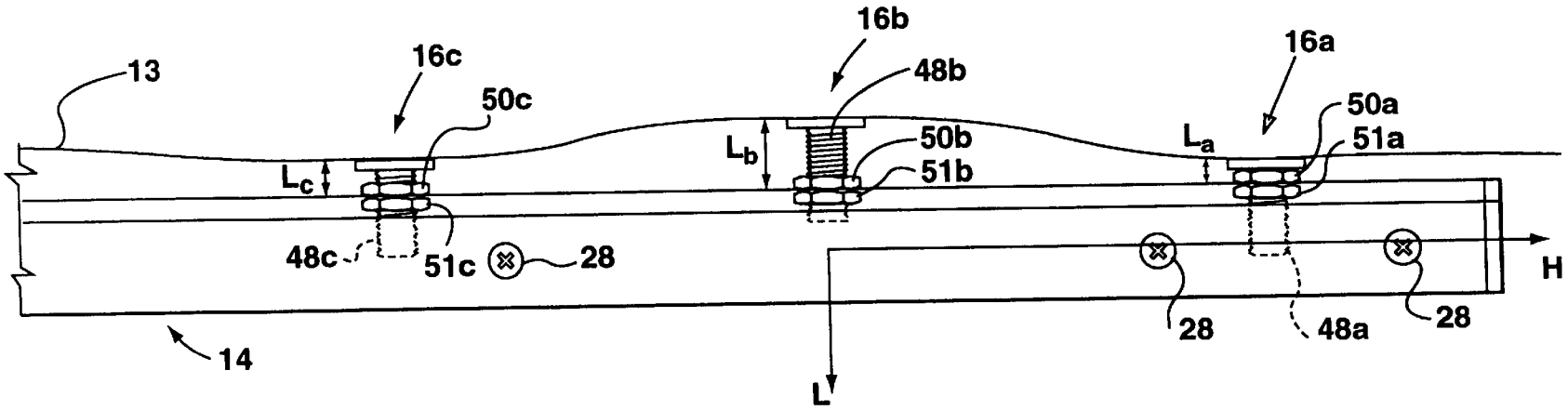
FIG. 5 is a top view of the track and three connectors of the preferred embodiment of the present invention.

FIG. 5 illustrates how three connectors 16*a*, 16*b* and 16*c* are used to couple a web 46 of one end of track 14 to wall 12 to maintain track 14 in a straight horizontal line. Wall 12 is shown having an uneven wall surface 13 with lateral irregularities.

Each connector 16*a*, 16*b*, and 16*c* can be used to offset track 14 from wall surface 13 laterally by adjusting the nuts 50*a* and 51*a*, 50*b* and 51*b*, and 50*c* and 51*c* on threaded sleeves 48*a*, 48*b*, and 48*c*, respectively. Accordingly, the unevenness of wall surface 13 can be compensated for by adjusting nuts 50*a* and 51*a* of connector 16*a* so that track 14 is laterally offset from wall surface 13 by $L_a$, adjusting nuts 50*b* and 51*b* of connector 16*b* so that track 14 is laterally offset from wall surface 13 by $L_b$, and adjusting nuts 50*c* and 51*c* of connector 16*c* so that track 14 is laterally offset from wall surface 13 by $L_c$ .

Figure 6:
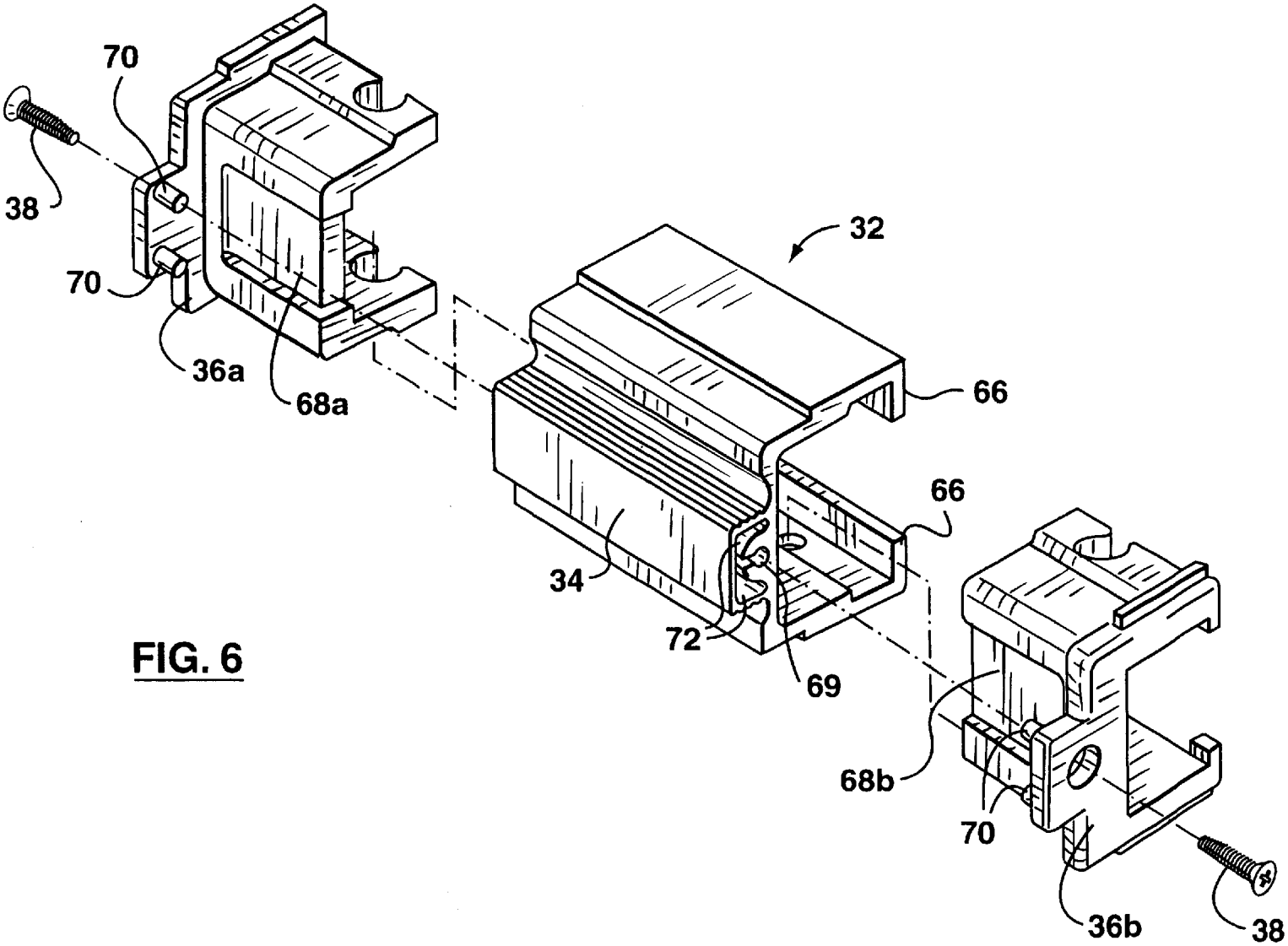
FIG. 6 is an exploded perspective view of the carriage body of the carriage of the preferred embodiment of the present invention.

FIG. 6 shows carriage body 32 having apertures 69 which are suited to receive screws 38 for securing end caps 36*a* and 36*b* to carriage body 32. Carriage body 32 further contains apertures 72 to receive end cap pins 70 when end caps 36*a* and 36*b* are attached to carriage body 32. Finger grip 34 is preferably formed in the front surface of extruded aluminum carriage body 32, although it could be made of flexible rubber for ease of manipulation.

Carriage end caps 36*a*, 36*b* have biasing arms 68*a*, 68*b* which deflect when mounting carriage 18 onto track 14. Once mounted, end caps 36*a*, 36*b*, clamp carriage body 32 onto track 14 by applying a central force to evenly force clamping legs 66 forward against track 14. In order to move carriage 18 along track 14, it is necessary to exert lateral pressure towards wall 12 on finger grip 34 to release clamping legs 66 from track 14. Carriage 18 may then be slid to the desired location and finger grip 34 released to allow biasing arms 68*a*, 68*b* to again clamp track 14. End caps 36*a* and 36*b* minimize direct contact between head 18 and track 14. This helps to eliminate marking and friction wear to these surfaces.

Figure 7:
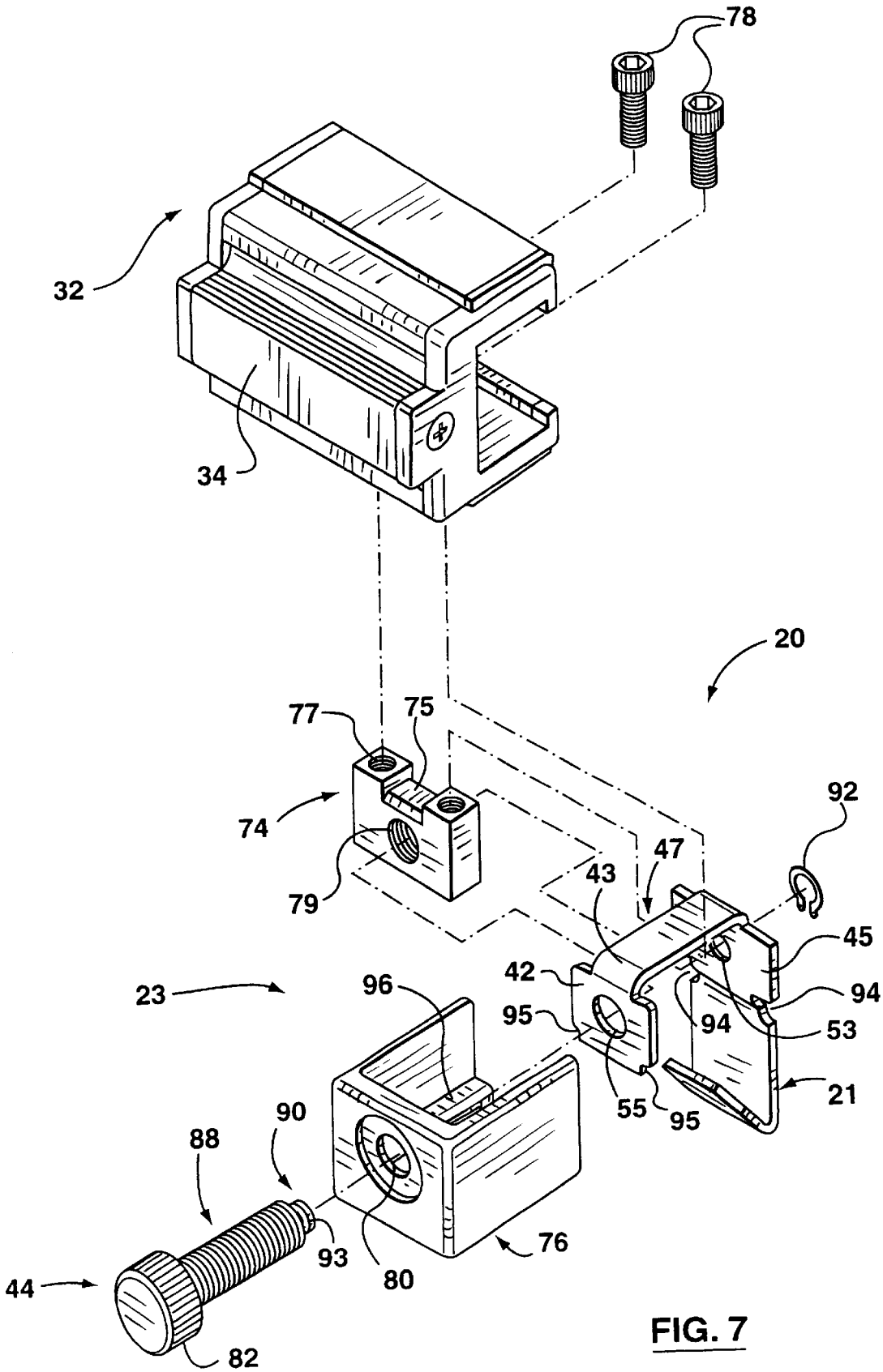
FIG. 7 is an exploded perspective view of the carriage body and the suspending device of the carriage of the preferred embodiment of the present invention.

Referring now to FIG. 7, suspending device 20 of carriage 18 preferably comprises hook 21 and hook position adjuster 23. Hook 21 is shaped to engage a wire or other attachment element attached to wall hanging 22. Hook 21 is preferably manufactured out of a durable material such as a metal alloy which is adapted to withstand the weight of a conventional wall hanging 22 and which will not suffer critically from fatigue.

Hook position adjuster 23 comprises a guide block 74, rigidly coupled to the underside of carriage body 32, hook bracket 47 which extends upwardly from hook 21, casing 76 sized to accommodate guide block 74 and hook bracket 47, and adjusting screw 44.

Guide block 74 is a generally rectangular solid block having a lateral guide slot 75 in its top surface. On either side of guide slot 75 are threaded apertures 77 for receiving screws 78 which rigidly couple guide block 74 to the underside of carriage body 32. Guide slot 75 is dimensioned to slidably receive hook bracket 47. Guide block 74 also contains a threaded lateral aperture 79 that runs through the centre of its body and which is dimensioned to engagably receive adjusting screw 44.

Hook bracket 47 extends upwardly from hook 21, and comprises a laterally extending top portion 43, a front plate 42 depending downwardly from and perpendicular to top portion 43, and a back plate 45 which is spaced from and parallel to front plate 42. Front plate 42 has an aperture 55 dimensioned to slidably receive adjusting screw 44. Back plate 45 has an aperture 53 which is smaller than aperture 55. The bottom surface of back plate 45 and the top surface of hook 21 contain indentations such that when plate 45 and hook 21 are joined together notches 94 are formed. Bottom surface of front plate 42 also contains notches 95 which are vertically aligned with notches 94.

Adjusting screw 44 has a large head 82 for ease of manipulation by the user, a uniform threaded central section 88 which fits through aperture 80 in casing 76 and which mates with threaded aperture 79 of guide block 74, and an end section 90 of reduced diameter. Aperture 53 of back plate 45 is dimensioned to receive end section 90 of adjusting screw 44 such that when adjusting screw 44 is positioned within hook bracket 47, end section 90 of adjusting screw 44 extends through back plate 45. End section 90 of screw 44 is also provided with a circular groove 93 for receiving retaining ring 92. Once end portion extends through back section 45 of hook 21, retaining ring 92 is snapped into grove 93 so as to retain end section 90 in back plate 45 as hook 21 is laterally adjusted towards and away from wall surface 13.

Casing 76 is dimensioned to cover guide block 74 and hook bracket 47 and further comprises alignment ledges 96 on its bottom side. Ledges 96 are spaced apart from each other and dimensioned to accommodate notches 94 and 95 such that hook 21 and hook bracket 47 can be laterally moved within casing 76.

When lateral top portion 43 of hook bracket 47 is engaged within guide slot 75 of guide block 74 and covered by casing 76, hook 21 extends below casing 76 to engage wall hanging 22. Once carriage 18 is positioned at the desired position on track 14, adjusting screw 44 can be used to move hook 21 towards or away from wall surface 13 as desired.

Figure 8:
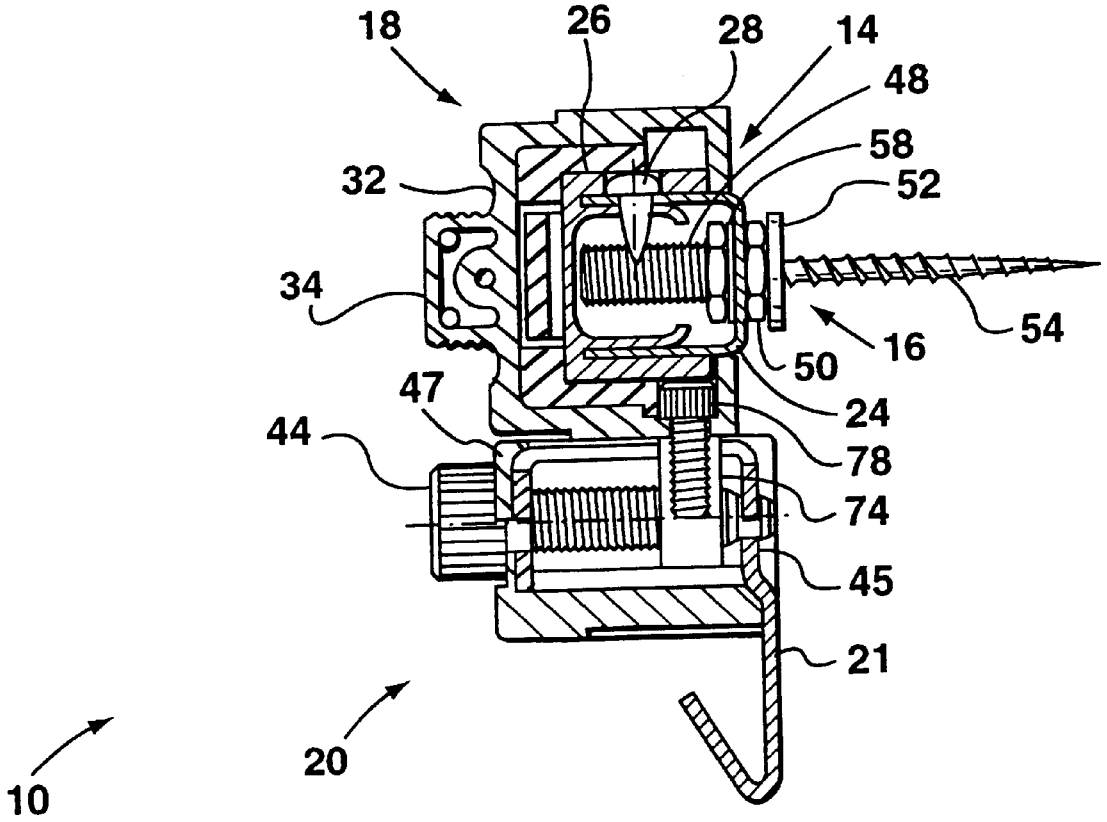
FIG. 8 is a side cross-sectional view of the track system according to the present invention.

FIG. 8 shows a side sectional view of track system 10 including track 14, connector 16, carriage 18 and suspending device 20. Since each part has already been described in detail above, the interrelationship of all the parts of track system 10 will be summarily discussed.

Wood screw 54 of connector 16 is shown engaged with wall 12 such that threaded sleeve 48 is positioned normal to wall 12 against center point guide 52. Secured threaded sleeve 48 is shown positioned within an aperture of track beam 24 such that web 46 of track 14 is gripped between nut 50 and washer 58 and nut 51, whereby track beam 24 is rigidly attached to wall 12. Track cover 26 is shown attached to track beam 24 using screws 28. Carriage 18 is shown engaged with track 14 having finger grip 34. Suspending device 20 is attached to carriage 18 using screws 78 that rigidly couple guide block 74 to the underside of carriage 18.

Figure 9:
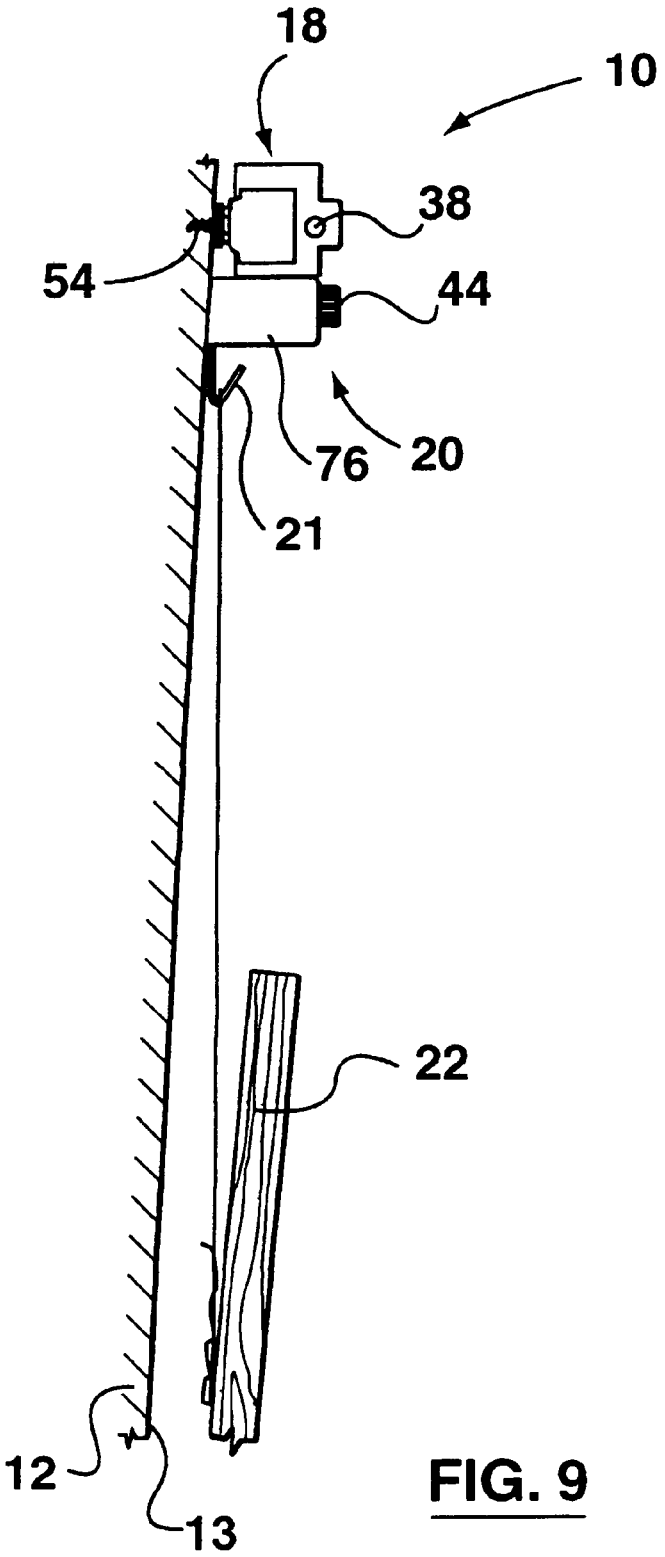
FIG. 9 is a side view of the track system in use with a typical wall hanging according to the present invention.

FIG. 9 shows a side view of track system 10 installed on wall 12 in use with wall hanging 22. Suspending device 20 is shown adjusted so as to position hook 21 flush against wall surface 13. By positioning back plate 45 in such a manner, wall hanging 22 can be hung on wall surface 13 as it would from a conventional hook or nail mounted on wall 12, even if the track is laterally offset from the wall surface because of a local surface irregularity.

In use, track beam 24 is preferably mounted on wall 12 at least six inches below the ceiling line such that approximately four inches are left between each end of track 14 and another wall or obstruction. A minimum of six inches of space is required to conveniently assemble track cover 26 onto track beam 24 with screws 28 using a conventional screw driver. Positioning track system 10 approximately 6–14 inches from the ceiling line provides a sleek architectural look similar to a conventional molding, and also eliminates any visual guide that might be made between a straight track 14 and an uneven ceiling surface. To accomplish mounting of track 14, track beam 24 is first positioned on wall 12 in order to determine placement of wood screws 54 and initial marking holes are made on wall surface 13 while track beam 24 is held in place manually.

Track beam 24 is then removed from wall surface 13 and threaded sleeves 48 are coupled to center point guides 52 both fastened to wall 12, such that center point guides 52 are placed flush against wall surface 13 at the marked positions, using wood screws 54. Nuts 50 are then placed on threaded sleeves 48 and track beam 24 is positioned on threaded sleeves 48 against nuts 50. Finally, nuts 51 and washer 58 are installed on threaded sleeves 48, so that track beam 24 is gripped in between nut pairs 50 and 51 on threaded sleeve 48.

Track cover 26 is then attached over track beam 24 and screws 28 are used to secure track cover 26 over track beam 24. Suspending device 20 is attached to the bottom of carriage body 32 using screws 78. Carriage 18 is then installed onto track 14 so that it may slide along the length of track 14. Once carriage 18 is positioned at the desired location on track 14, adjusting screw 44 is adjusted to position hook 21 laterally relative to wall surface 13.

Should the user desire to repaint or otherwise decorate wall surface 13, track 14 can be removed and reinstalled without having to readjust connectors 16. Removal is accomplished by removing screws 28, end caps 30 and front cover 26, and then removing wood screws 54 together with track beam 24, with threaded sleeves 48, nuts 50, 51 and washer 58 being still firmly attached and correctly adjusted to back web 46. The wall surface can then be painted. Track 14 is reinstalled by holding beam 24 in place and reinstalling wood screws 54, then front cover 26 and end caps 30 with screws 28.

The subject invention accordingly provides a track system which allows wall hangings to be suspended and easily repositioned along the length of track 14 at various positions on wall 12 without damaging the wall surface with each repositioning. Track system 10 is further adapted to suspend wall hangings evenly on an irregular wall surface through the adjustment of connectors 16. Track system 10 also allows heavier wall hangings, such as flat screen television monitors and stereo equipment, to be suspended from track 14 regardless of the location of wall stud beams in the wall. Since suspending device 20 consists in part of a hook 21, track system 10 can be used in association with conventional wire hung wall hangings. Track 14 can also be easily removed and reinstalled for redecorating purposes without having to readjust connectors 16.

Figure 10:
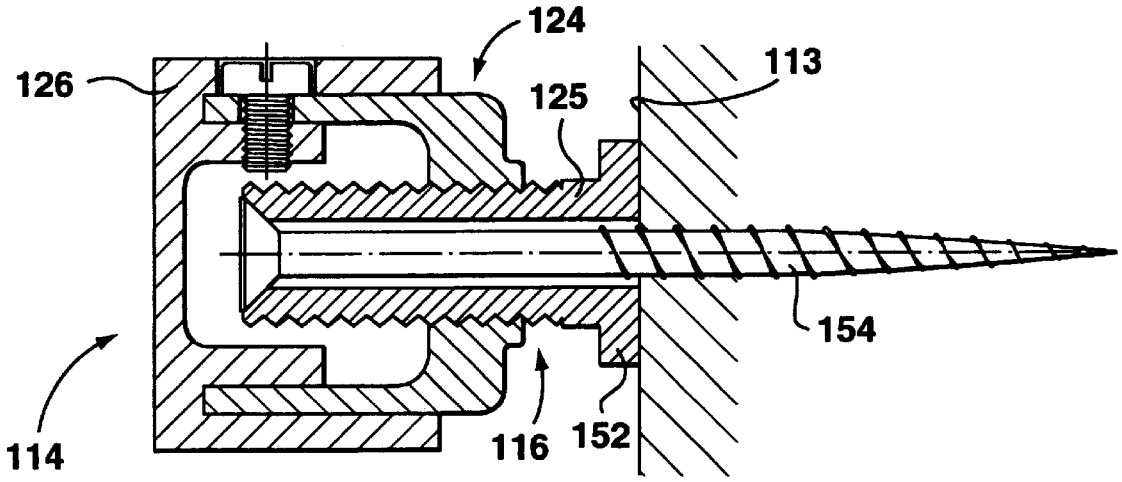
FIG. 10 is a cross-sectional view of a track assembly made in accordance with an alternative embodiment of the present invention.
Figure 11:
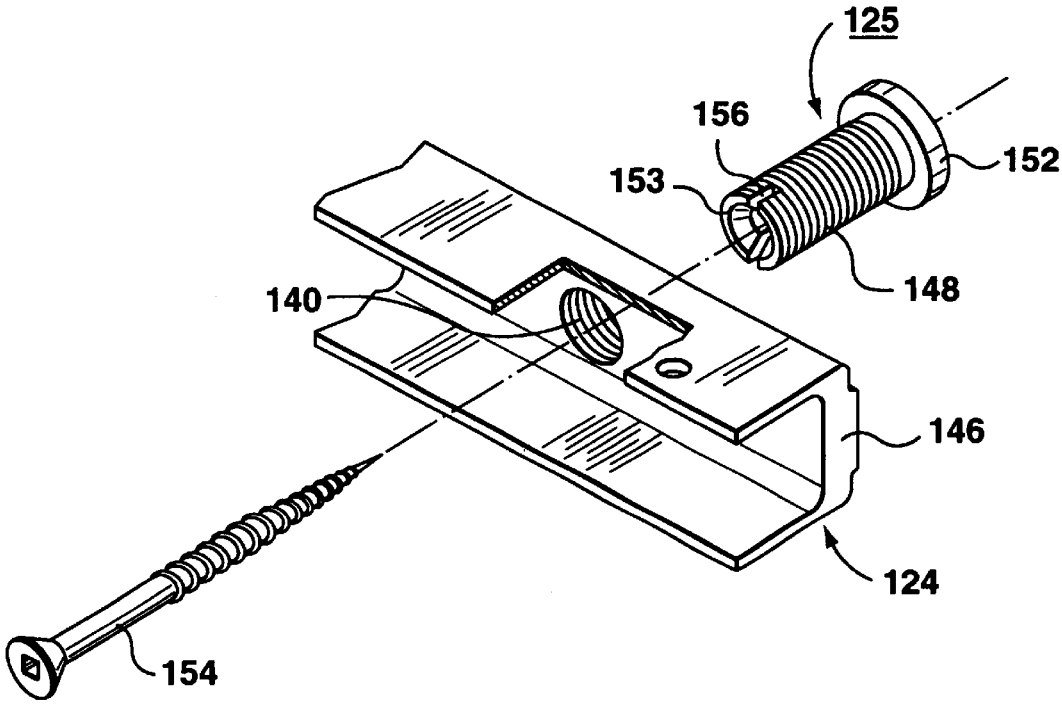
FIG. 11 is a perspective view of a connector and a portion of a track beam made in accordance with the alternative embodiment shown in FIG. 10.
Figure 12:
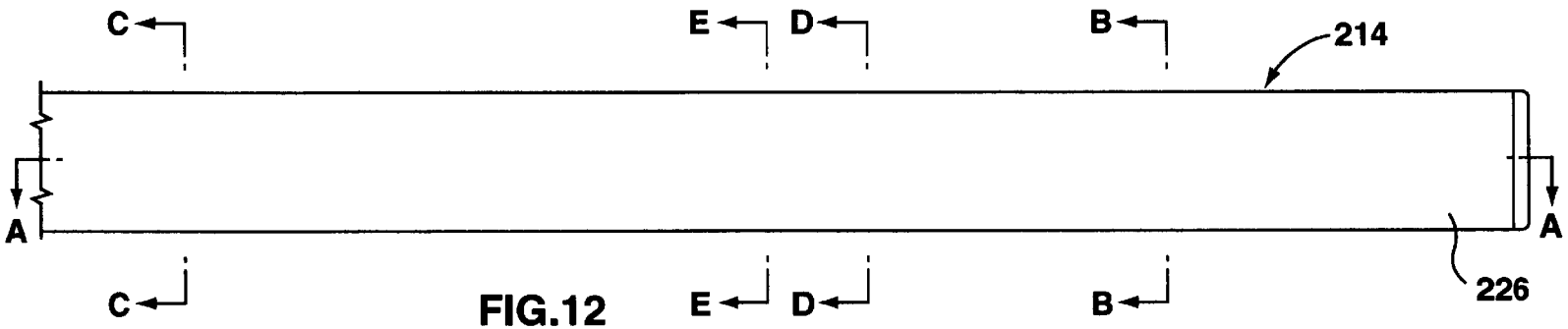
FIG. 12 is a front elevational view of a track system made in accordance with a further embodiment of the present invention.
Figure 13:
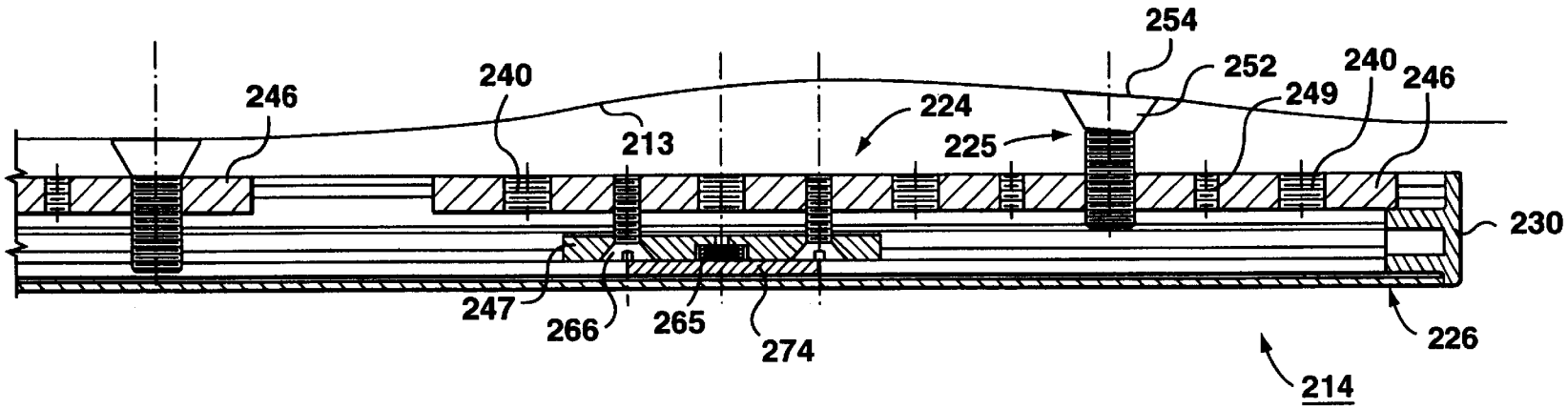
FIG. 13 is a sectional view taken along lines A—A in FIG. 12.

Referring now to FIGS. 10 and 11, a track system made in accordance with an alternative embodiment of the invention comprises a track assembly 114 and a plurality of connectors 116. Track assembly 114 comprises a track beam 124 and a front cover 126. Track beam 124 has a thick back wall 146 containing a series of spaced threaded apertures 140. Connector 116 comprises a one piece adjuster 125 and a fastener 154. Adjuster 125 comprises threaded sleeve 148, integral foot 152 extending laterally from the foot end of sleeve 148, and a screwdriver slot 156 formed in head end 153. Threaded sleeve 148 of adjuster 125 is sized to mate with threaded apertures 140. The threads of threaded sleeve 148 preferably stop about ⅛ inch from center point guide 152, to ensure a minimum ¼ inch distance between track beam 124 and wall surface 113. Threaded apertures 140 in thick back wall 146 eliminate the need for nuts 50, 51 and washer 52 of the previous embodiment. Screwdriver slot 156 allows the user to adjust the length of adjuster 125 extending between wall surface 113 and track beam 124, without having to use a socket wrench.

The process for installing track assembly 114 on a wall or other structure is similar to that for the previous embodiment. Once a horizontal height line is established and the wall stud center lines are located and marked, track beam 124 is positioned against wall surface 113. The stud center lines are then centered in threaded apertures 140, and those apertures 140 having a stud location are marked. Track beam 124 is removed from the wall, and adjusters 125 are threaded into the backside of each marked aperture until they stop. Track beam 124 is returned to the wall position. Adjusters 125 closest to the ends of beam 124 are adjusted in length using a flat head screwdriver, to align the track beam 124 in a straight line, and fasteners 154 are inserted into adjusters 125 to fasten the track beam 124 to wall. The lengths of the other adjusters 125 are then adjusted, until foot 152 of each adjuster 125 contacts surface 113, and fasteners 154 are installed.

Referring now to FIGS. 12–15, in another preferred embodiment, the track system of the subject invention comprises a track assembly 214 and a plurality of connectors 216. Connectors 216 comprise swivel foot adjusters 225 and fasteners 227. Swivel foot adjuster 225 comprises a threaded sleeve 248 having an adjustment slot 256 like slot 156 of the previous embodiment. However, swivel foot adjuster 225 differs from adjuster 125 of the previous embodiment, in that adjuster 225 comprises a foot 252 pivotally coupled to threaded sleeve 248. Foot 252 has a frusto-conical side surface 282, a flat bottom surface 254 and a central bore 257 having a front lip 258 sized to fit over threadless section 259 of threaded sleeve 248 adjacent the foot end thereof. Foot 252 is coupled to adjuster 225 by sliding foot 252 onto threadless section 259 and fitting o-ring 255 into groove 253. When adjuster 225 is positioned on a structure having a local surface irregularity, each pivoting foot 252 pivots as necessary, providing full perimeter contact between surface 213, for maximum track support and a visually pleasing appearance. Feet 252 preferably pivot over an angle of about 7 degrees.

Figure 14:
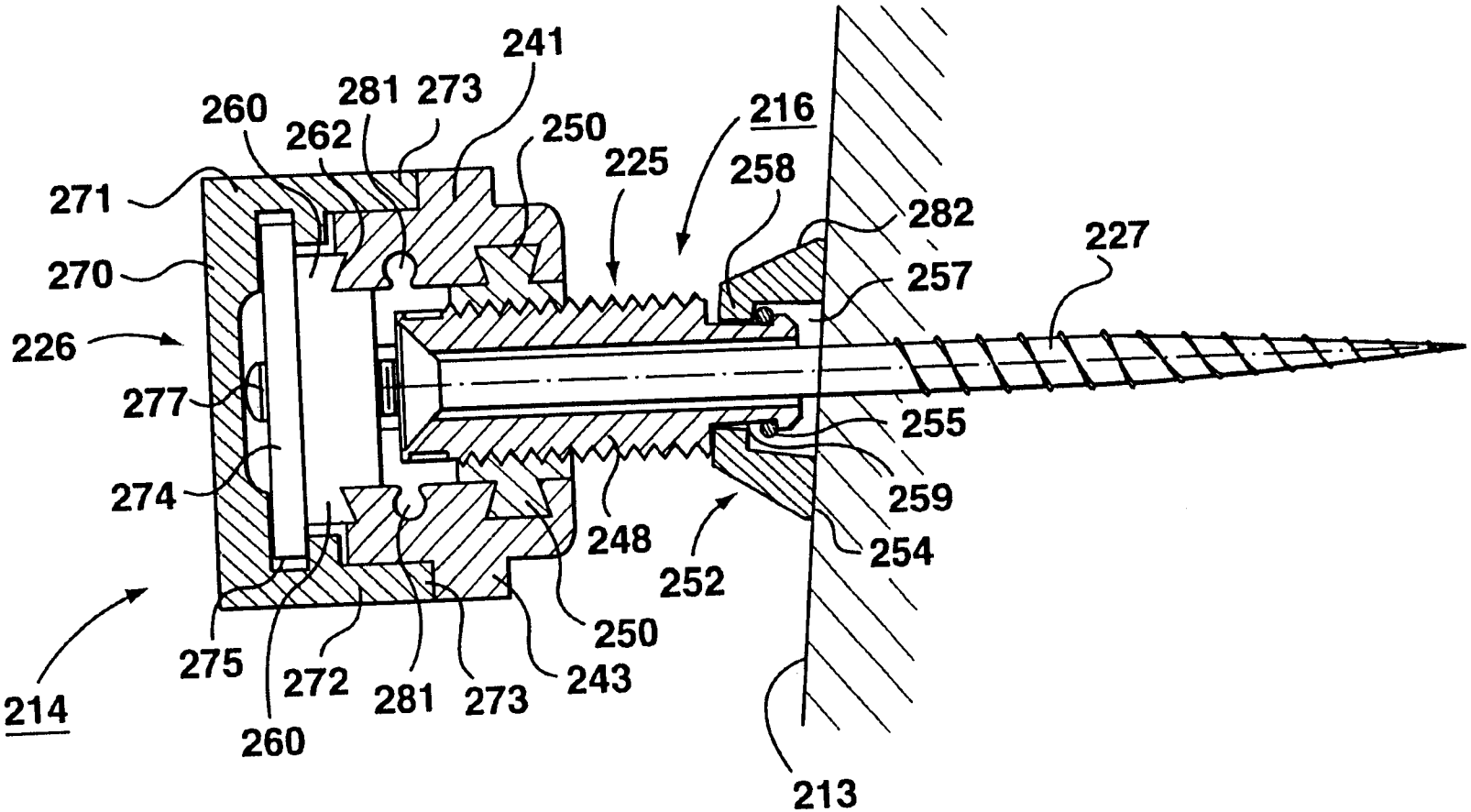
FIG. 14 is a sectional view taken along lines B—B in FIG. 12.
Figure 15:
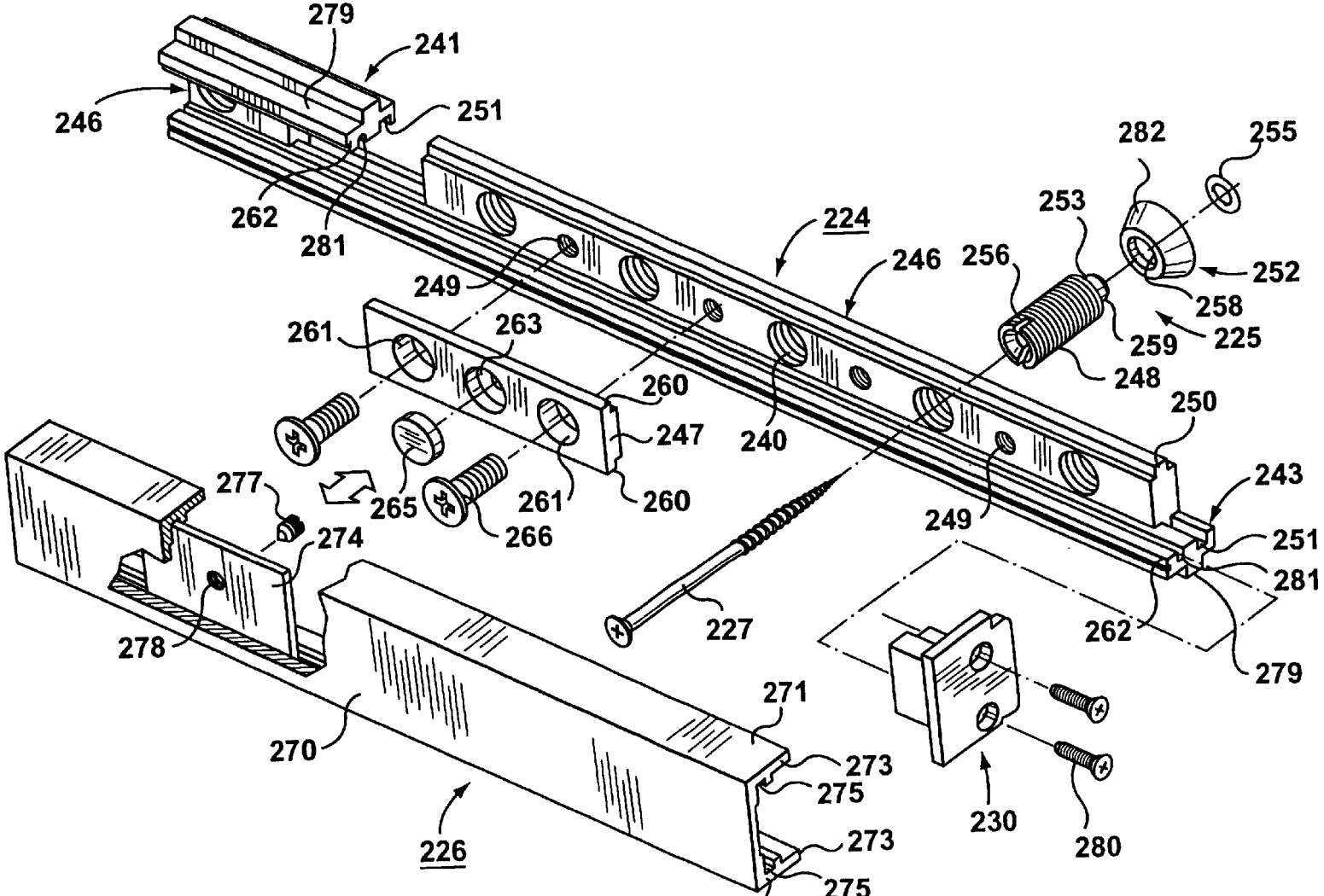
FIG. 15 is an exploded perspective view of the components of the track system shown in FIGS. 12–14.

Track assembly 214 comprises a front cover 226, back wall assembly 224, and end caps 230. Back wall assembly 224 comprises a plurality of sliding wall sections 246, header 241 and footer 243 shaped to slidingly receive wall sections 246, and tie-bars 247. Header 241 and footer 243 extend the entire length of track assembly 214; in FIG. 15, header 241 is shown pulled back beyond right-hand sliding wall section 246, for clarity of illustration. As shown in FIGS. 14 and 15, dovetail projections 250 extend longitudinally along the top and bottom of sliding wall section 246. Dovetail projections 250 are sized to slidingly fit within dovetail channels 251 in header 241 and footer 243. Each sliding wall section 246 is provided with spaced threaded adjuster apertures 240 sized to receive threaded sleeve 248 of a swivel-foot adjuster 225. A smaller threaded tie bar aperture 249 is located between pairs of adjuster apertures 240. Sliding wall sections 246 are preferably about 10 inches in length, and adjuster apertures 240 are preferably ½ inch in diameter and spaced about 2 inches apart.

Tie-bar 247 and securing screws 266 are used to secure each sliding wall section 246 to footer 243 and header 241. Tie-bar 247 contains a pair of apertures 261 spaced to register with threaded tie bar apertures 249. Tie-bar 247 also comprises top and bottom flanges 260 shaped to bear against bevelled side surfaces 262 of header 241 and footer 243. Securing screws 266 are used to fasten tie-bar 247 onto sliding wall section 246, thereby tying back wall assembly 224 together. Tie-bar 247 is also provided with a centrally located recess 263 sized to receive magnet 265.

Front cover 226 comprises a front wall 270, a top flange 271 and a bottom flange 272. Top flange 271 and bottom flange 272 have rear lips 273 shaped to engage surfaces 279 of header 241 and footer 243, when cover 226 is fitted onto back wall assembly 224. Front cover 226 includes a magnetic contact plate 274 which is shaped to be slidingly received in channels 275 in top and bottom flanges 271, 272, and a set screw 277 sized to be threaded into aperture 278, which locks contact plate 274 in channel 275. Contact plate 274 is made of steel or other magnetic metal. Contact plate 274 should be positioned so as to bear against magnet 265 of tie-bar 247, when cover 226 is fitted onto back wall assembly 224.

End caps 230 are snaped into the ends of cover 226 and secured to back wall assembly 224 by inserting screws 280 into channels 281 in header 241 and footer 243.

Track assembly 214 may be used to mount different objects on various structures such as walls or ceilings. Using a wall as an example, track assembly 214 may be installed as follows:

1. With a pencil and level, lightly mark the tracks horizontal center line length on wall surface 213.
2. Locate and mark along the horizontal line all hidden vertical wall beam center lines.
3. Where the length is expected to exist, measure from end to end along the horizontal line and record the distance of each intersecting line.

4. Remove front cover 226 and set aside. Place back wall assembly 224 on the floor with the back wall section 246 down.
5. Remove all securing screws 266 and tie-bars 247.
6. Place a sliding back wall section 246 at each track end and evenly space the others.
7. In the same direction as measured in step 3, align the first recorded measurement with the center of the nearest ½ inch threaded back wall aperture 240.
8. Without covering the measured aperture 240, fasten back wall section 246 in place with a tie-bar 247 and securing screws 266.
9. Repeat steps 7 and 8 for the next and each additional recorded measurement. Note: Some back walls sections 246 may fall between measurements. Center any unused back wall sections 246 and fasten in place with tie-bars 247 and securing screws 266.
10. Thread an adjuster 225 all the way into the back side of each measured adjuster aperture 240.
11. On the wall, drill pilot holes for wood screws 227 at intersecting lines (measured holes/wall beam center lines).
12. Use the front cover 226 as a straight edge, just above or below the horizontal line to check the wall surface for high spots. Lightly mark the 2 pilot holes that represent the two highest surface locations.
13. Hold back wall assembly 224 in position and insert a screw 227 into both adjusters 225 with marked pilot holes and fasten in place.
14. With a slot screw driver adjust each adjuster 225 in length until the leading perimeter of foot 252 is in full contact with wall surface 213.
15. Into each adjuster 225 insert a screw 227 to fasten in place. Note: If the track beam needs to be fine-tuned horizontally slightly loosen all tie-bar screws 266, and adjust track and retighten screws 266.
16. Insert magnets 265 into tie-bar center recesses 263.
17. From either end of back wall assembly 224, measure and record the center point of each magnet 265.
18. Align the front cover 226, contact plates 274 and tighten each set screw 277 to correspond with a magnet 265 center point as measured and recorded in step 17.
19. Position the front cover 226 between the track beam end caps 230 with the rear lips 273 ready to engage header 241 and footer 243.
20. Move front cover 226 towards the wall for magnetic contact.

Note: To remove front cover 226, first remove screws 280 and end caps 230, and then move front cover 226 horizontally, right or left, to disengage contact plates 274 from the attractive force of magnets 265.

Sliding wall sections 246 of track assembly 214 provide for precise alignment of threaded adjuster apertures 240 with the vertical center lines of stud beams in the wall, thereby making track assembly 214 particularly well adapted for use on walls having irregular spacing of studs.

While the track system of the subject invention is suitable for positioning decorative wall hangings and heavier objects like television monitors and audio speakers on the interior walls of residential or commercial buildings, such system could also be used for mounting various objects on other structures, e.g. mounting track lighting on a ceiling.

As will be apparent to persons skilled in the art, various modifications and adaptations of the apparatus described above are possible without departure from the present invention, the scope of which is defined in the appended claims.

I claim:

1. A track system for adjustably mounting objects to a structure having a surface, comprising:

(a) an elongated track dimensioned to extend along the surface; and (b) a plurality of longitudinally spaced connectors extending between the track and the surface for rigidly coupling the track to the structure and aligning the track in a straight line offset from the surface, each of the connectors being individually adjustable in length so as to compensate for local irregularities in the surface.

2. The track system defined in claim 1, wherein each of the connectors comprises an adjuster of adjustable length couplable to the track, and a fastener for fastening the adjuster to the structure.

3. The track system defined in claim 2, wherein the adjuster comprises a threaded portion and the track is provided with a plurality of longitudinally spaced threaded apertures sized to accommodate one of the adjusters.

4. The track system defined in claim 3, wherein the adjuster comprises a threaded sleeve having an outside surface shaped to mate with one of the threaded apertures and a central bore sized to receive the fastener.

5. The track system defined in claim 4, wherein the fastener comprises a screw having a threaded end dimensioned to extend through the bore of the threaded sleeve so as to securely engage the structure, and a head dimensioned to be larger than the bore, such that when the threaded end of the screw is securely engaged with the structure, the head securely biases the threaded sleeve to the surface.

6. The track system defined in claim 4, wherein the adjuster comprises a foot extending from one end of the threaded sleeve, the foot having a flat bottom surface for bearing against the surface of the structure when the adjuster is installed.

7. The track system defined in claim 6, wherein the foot is pivotally connected to the one end of the threaded sleeve.

8. The track system defined in claim 7, wherein the foot has a frusto-conical side surface.

9. The track system defined in claim 8, wherein the foot is coupled to the threaded sleeve by an o-ring dimensional to fit into a groove formed in a portion of the threaded sleeve adjacent the one end thereof.

10. The track system defined in claim 6, wherein the adjuster comprises an adjustment slot formed in the other end of the threaded sleeve, the adjustment slot being shaped to fit a flat head screwdriver blade.

11. The track system defined in claim 2, wherein the track comprises a back wall assembly and a front cover shaped to cover the back wall assembly.

12. The track system defined in claim 11, wherein the back wall assembly comprises a plurality of movable wall sections having a series of longitudinally spaced apertures therein sized to fit the adjusters, the movable wall sections being longitudinally movable during installation so as to align one of the apertures with a supporting portion of the structure.

13. The track system defined in claim 12, wherein the back wall assembly comprises a footer and a header, the footer and the header being shaped to slidingly receive the movable wall sections therebetween.

14. The track system defined in claim 12, wherein the apertures in the movable wall section are threaded, and the adjuster comprises a threaded sleeve sized to fit the apertures.

15. The track system defined in claim 13, wherein the back wall assembly further comprises a tie-bar for tying the movable wall section to the footer and the header during installation, once the movable wall section has been aligned with the supporting portion.

16. The track system defined in claim 11, wherein the cover comprises a magnetic portion and the back wall assembly comprises a magnet for contacting the magnetic portion when the cover is fitted onto the back wall assembly.

17. The track system defined in claim 16, wherein the cover comprises a front wall and the magnetic portion comprises a metal plate, the metal plate being adjustably positionable relative to the front wall.

18. The track system defined in claim 17, wherein the cover comprises a pair of longitudinally extending channels sized to fit the metal plate and a fastener for releasably securing the plate within the channels.

19. The track system defined in claim 1, further comprising at least one carriage shaped for engaging and sliding along the track, the carriage comprising a mounting device for mounting an object thereto.

20. A track system for adjustably mounting objects to a structure, comprising:

(a) an elongated track dimensioned to extend along the surface; and (b) a plurality of longitudinally spaced connectors extending between the track and the surface for rigidly coupling the track to the structure;

(c) wherein the track comprises a back wall assembly and a front cover shaped to cover the back wall assembly; and (d) wherein the back wall assembly comprises a header, a footer, and a plurality of movable wall sections, the header and the footer being shaped to slidingly receive the movable wall sections there between, the movable wall sections having a series of longitudinally spaced apertures therein sized to fit the connectors, the movable wall sections being longitudinally movable during installation so as to align one of the apertures with a supporting portion of the structure.

21. A track system for adjustably mounting objects to a structure having a surface, comprising:

(a) an elongated track dimensioned to extend along the surface; and (b) a plurality of longitudinally spaced connectors extending between the track and the surface for rigidly coupling the track to the structure;

(c) wherein the track comprises a back wall assembly and a front cover shaped to cover the back wall assembly; and (d) wherein the cover comprises a magnetic portion and the back wall assembly comprises a magnet for contacting the magnetic metal portion when the cover is fitted onto the back wall assembly.

* * * * *